US008410989B2

(12) United States Patent
Hayakawa et al.

(10) Patent No.: US 8,410,989 B2
(45) Date of Patent: Apr. 2, 2013

(54) ANTENNA STRUCTURE INCLUDING RADIATING CONDUCTOR AND MAGNETIC MATERIAL HAVING DIELECTRIC PROPERTY

(75) Inventors: Masatoshi Hayakawa, Kanagawa (JP); Kiyotada Yokogi, Tokyo (JP); Yoshimi Takahashi, Miyagi (JP); Kenji Asakura, Fukui (JP); Shuichi Goto, Miyagi (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/511,621

(22) Filed: Aug. 29, 2006

(65) Prior Publication Data

US 2007/0080866 A1 Apr. 12, 2007

(30) Foreign Application Priority Data

Sep. 1, 2005 (JP) ..... 2005-253081

(51) Int. Cl.
*H01Q 1/00* (2006.01)
*H01Q 1/38* (2006.01)

(52) U.S. Cl. ..... 343/787; 343/700 MS

(58) Field of Classification Search ..... 343/700 MS, 343/787

See application file for complete search history.

(56) References Cited

U.S. PATENT DOCUMENTS 5,327,148 A * 7/1994 How et al. ..... 343/700 MS
5,900,845 A * 5/1999 Mandai et al. ..... 343/895
6,677,901 B1 * 1/2004 Nalbandian ..... 343/700 MS
6,850,779 B1 * 2/2005 Iguchi et al. ..... 455/562.1
2002/0075186 A1 * 6/2002 Hamada et al. ..... 343/700 MS
2004/0189528 A1 * 9/2004 Killen et al. ..... 343/700 MS

FOREIGN PATENT DOCUMENTS

| | | |
|---|---|---|
| JP | 04-354401 | 8/1992 |
| JP | 2000-269731 | 9/2000 |
| JP | 2001-102813 | 4/2001 |
| JP | 2003-142915 | 5/2003 |
| JP | 2004-007510 | 1/2004 |
| JP | 2004-104430 | 4/2004 |

OTHER PUBLICATIONS

Sumi, "A Study on Antennas Utilizing Magnetic Materials", Yokohama National University, class 2002.

Tanaka et al., "An Investigation on Reduction in Size of Portable Terminal Antenna using Magnetic Material", Institute of Electronics, Information and Communication Engineers, Ronbunshi B, vol. J87-B, No. 9, pp. 1327-1335, 2004.

* cited by examiner

*Primary Examiner* — Trinh Dinh

(74) *Attorney, Agent, or Firm* — Robert J. Depke; The Chicago Technology Law Group, LLC

(57) ABSTRACT

An antenna for receiving electromagnetic waves in a desired frequency band, includes a radiating conductor and a ground conductor, a feeder part, a wavelength-shortening section, and a magnetic field applying section. The radiating conductor and a ground conductor resonate at a resonance point frequency. The feeder part is configured to feed the radiating conductor with electricity. The wavelength-shortening section in which a magnetic body having both a dielectric property and a magnetic property is disposed close to the radiating conductor shifts the resonance point frequency into a band lower than the desired frequency band by a wavelength-shortening effect obtained based on the dielectric property and the magnetic property. The magnetic field applying section is configured to apply a magnetic field to the magnetic body so as to reduce a magnetic loss due to the magnetic body.

11 Claims, 17 Drawing Sheets

ANTENNA STRUCTURE INCLUDING RADIATING CONDUCTOR AND MAGNETIC MATERIAL HAVING DIELECTRIC PROPERTY

CROSS REFERENCES TO RELATED APPLICATIONS

The present invention contains subject matter related to Japanese Patent Application JP 2005-253081 filed with the Japanese Patent Office on Sep. 1, 2005, the entire contents of which being incorporated herein by reference.

BACKGROUND OF THE INVENTION

1. Field of the Invention

The present invention relates to a small-sized antenna capable of being incorporated in an apparatus such as a movable body communication apparatus, particularly to a small-sized antenna capable of receiving electromagnetic waves in a UHF television band with comparatively long wavelengths.

To be more specific, the present invention relates to an antenna configured in a small size while being improved in standing wave ratio in a used band by shifting a resonance point frequency into a lower band through a wavelength-shortening effect, particularly to an antenna configured in a small size by utilizing a wavelength-shortening effect obtained from a magnetic body having both a dielectric property and a magnetic property.

2. Description of the Related Art

In relation to portable radio apparatuses such as cellular phones, it is requested to further reduce the sets in size and weight while contriving enhanced functions. Accordingly, there has been an increasing demand for a reduction in the size of an antenna which is mounted on or in each of these apparatuses to perform transmission and reception (refer to, for example, "Antennas for Portable Apparatuses: Challenges for 'Wide-band and yet Small'" (*Nikkei Electronics*, Nov. 22, 2004, pp. 69 to 80) (Non-Patent Document 1)).

An antenna, basically, is composed of a radiating element, a feeder line for feeding the radiating element with electricity, and a ground for grounding the radiating element. Here, a close relationship exists between the size of the antenna for transmission and reception, or the element length of the antenna, and the operating frequency. For example, in a monopole type antenna with a radiating element disposed on a ground, the element length is often set to be about quarter wavelength relevant to the operating frequency, from the viewpoint of efficiency or the like, even where a smaller size is contrived. Therefore, it is a common practice to contrive a smaller antenna size by shortening the wavelength of the electromagnetic field between the radiating element and the ground conductor.

For example, there has been known a dielectric antenna in which the element length is shortened by disposing the radiating element in proximity to a dielectric, paying attention to the wavelength-shortening effect possessed by the dielectric. This depends on the fact that the velocity of electromagnetic waves is lower in substances than in vacuum (refer to, for example, Hidetoshi Takahashi, *Electromagnetics*, p. 329, Butsurigaku Sensho 3, Shokabo, in 1970 (Non-Patent Document 2)). Let the frequency of an electromagnetic wave be f, let the velocity of the electromagnetic wave in vacuum be c, then the wavelength $\lambda_0$ is represented by the following equation (1):

$$\lambda_0 = \frac{c}{f} \tag{1}$$

On the other hand, the propagation velocity c of electromagnetic waves in vacuum and the velocity v of the waves in a substance are represented respectively by the following equations (2) and (3), where $\in_0$ and $\mu_0$ are the dielectric constant and the permeability in vacuum, and $\in_r$ and $\mu_r$ are the relative dielectric constant and the relative permeability in the substance.

$$c = \frac{1}{\sqrt{\varepsilon_0 \mu_0}} \tag{2}$$

$$v = \frac{1}{\sqrt{\varepsilon_0 \varepsilon_r \mu_0 \mu_r}} \tag{3}$$

Since the wavelength $\lambda$ of an electromagnetic wave with a frequency f in the substance is obtained as $\lambda = v/f$, its ratio to the wavelength $\lambda_0$ in vacuum is given by the following equation (4).

$$\lambda/\lambda_0 = (v/f) \times (f/c) = 1/\sqrt{\in_r} \tag{4}$$

For example, the wavelength $\lambda$ of the electromagnetic wave in a dielectric with a relative dielectric constant $\in_r$ is represented by the following equation (5), which shows that the wavelength $\lambda$ is made shorter than the wavelength $\lambda_0$ in vacuum by a factor of $1/\in_r$ due to the wavelength-shortening effect of the dielectric.

$$\lambda = \frac{\lambda_0}{\sqrt{\varepsilon_r}} \tag{5}$$

The dielectric chip antenna and the dielectric patch antenna, in which a radiating element is provided in the inside of a dielectric or at a surface of a dielectric, have recently been put to practical use in a variety of fields, as a small-sized transmission/reception antenna mainly for the GHz band.

Besides, the wavelength $\lambda$ of the electromagnetic wave propagated through a magnetic body with a relative dielectric constant $\in_r$ and a relative permeability $\mu_r$ is represented by the following equation (6). In other words, a magnetic body having both a dielectric property and a magnetic property can shorten the wavelength further than in the case of using a dielectric, by a factor of $1/\mu_r$.

$$\lambda = \frac{\lambda_0}{\sqrt{\varepsilon_r \cdot \mu_r}} \tag{6}$$

According to the above equation (6), in principle, a material having a relative dielectric constant of 5 and a relative permeability of 5, for example, may show a wavelength-shortening effect equivalent to that a dielectric having a relative dielectric constant of 25. However, as of the time of the present application, examples of application of magnetic bodies to antennas have been limited; even ferrites showing low losses at high frequencies have been used as bar antennas for AM broadcast receivers, and there have been known few examples of application in frequency regions at or above the MHz band. In the case where a magnetic body has a dielectric property as well, both a magnetic loss and a dielectric loss will be generated, leading to a lowering in radiation efficiency (refer to, for example, Japanese Patent Laid-open No. 2004-7510, paragraph No. 0006 (Patent Document 1)).

Recently, there have been a few examples of investigation made on magnetic materials from the viewpoint of contriving a reduced antenna size. It has been suggested, for example, that when a simulation with material characteristics as parameters is conducted and a magnetic body satisfying certain conditions is used, a reduction in the size of a patch antenna or helical antenna can be achieved (refer to, for example, Hiromu Sumi, "A Study on Antennas Utilizing Magnetic Materials", a graduation thesis in the Department of Engineering of Yokohama National University in the class of 2002 (Non-Patent Document 3)).

Besides, it has been reported that when a flat plate inverse F antenna of 55 mm by 40 mm in size for 900 MHz band is used with the antenna substrate replaced by a magnetic body, the size thereof can be reduced to about 34 mm×30 mm, i.e., a reduction of up to about 50% in area ratio can be achieved (refer to, for example, Tomoteru Tanaka, Shogo Hayashida, Kazushi Imamura, Hisashi Morishita, and Yoshio Koyanagi, "An Investigation on Reduction in Size of Portable Terminal Antenna using Magnetic Material" (the Institute of Electronics, Information and Communication Engineers, Ronbunshi B, Vol. J87-B, No. 9. pp. 1327 to 1335, 2004) (Non-Patent Document 4)).

However, in the case of replacing the substrate of an antenna by a magnetic body, the shape of the antenna is limited to flat plate-like shapes. In addition, where reception of television broadcast in a UHF band at much lower frequencies, for example, about 500 to 800 MHz is considered, the occupying area is expected to be naturally larger than that in the above-mentioned report. Therefore, where mounting of antennas on portable apparatuses is considered, development of a technology for further reductions in the antenna size is desired.

SUMMARY OF THE INVENTION

Thus, there is a need to provide an excellent small-sized antenna capable of being incorporated in an apparatus such as a movable body communication apparatus and capable of receiving electromagnetic waves in the UHF television band with comparatively longer wavelengths.

There is another need to provide an excellent antenna configured in a small size while being improved in standing wave ratio in the use band by shifting the resonance point frequency into a lower band through a wavelength-shortening effect.

There is a further need to provide an excellent antenna configured in a small size by utilizing a wavelength-shortening effect obtained from a magnetic body having both a dielectric property and a magnetic property.

In order to fulfill the above needs, according to an embodiment of the present invention, there is provided an antenna for receiving electromagnetic waves in a desired frequency band, including:

a radiating conductor and a ground conductor which resonate at a resonance point frequency;

a feeder part configured to feed the radiating conductor with electricity;

wavelength-shortening means in which a magnetic body having both a dielectric property and a magnetic property is disposed close to the radiating conductor and which shifts the resonance point frequency into a band lower than the desired frequency band by a wavelength-shortening effect obtained based on the dielectric property and said magnetic property; and magnetic field applying means configured to apply a magnetic field to the magnetic body so as to reduce a magnetic loss due to the magnetic body.

The need for reductions in the size of antennas mounted on portable apparatuses so as to perform transmission and/or reception has been increasing more and more. However, the element length of an antenna is set to about quarter wavelength relevant to the operating frequency, from the viewpoint of efficiency or the like. Therefore, in order to obtain a reduced size, it may be necessary to shorten the wavelength of an electromagnetic field between a radiating conductor and a ground conductor.

In the case of shortening the wavelength by use of a magnetic body having both a dielectric property and a magnetic property, it is possible to obtain a higher effect than that in the case of using a dielectric, by an extent corresponding to the product of relative dielectric constant multiplied by relative permeability. However, where the magnetic body has the dielectric property as well, both a magnetic loss and a dielectric loss will be generated, leading to a lowering in radiation efficiency.

In view of this, according to the embodiment of the present invention, in the case where the magnetic body having both a dielectric property and a magnetic property is disposed close to the radiating conductor so as to obtain a wavelength-shortening effect based on the dielectric property and the magnetic property, a magnetic field is applied to the magnetic body so as thereby to lower the magnetic loss due to the magnetic body. As a result, a wavelength-shortening effect so high as not to be obtainable with a non-magnetic dielectric can be obtained through the use of a magnetic material having both a dielectric property and a magnetic property as a wavelength-shortening material.

Here, basically, the magnetic field applying means applies a DC magnetic field.

Besides, in the case of a quarter-wavelength grounded antenna, the current distribution is maximized at the feeder end and is zero at the open end. Therefore, in order to effectively utilize the permeability of the magnetic body, it is effective to dispose the magnetic body at a portion where current density is high. In addition, it is effective to apply an external magnetic field, which is applied for reducing the loss due to the magnetic body, to a portion where the current density is high.

As a method of disposing the magnetic body of the wavelength-shortening means close to the radiating conductor, there may be contemplated, for example, a method wherein the radiating conductor is formed inside the magnetic body, or a method wherein the radiating conductor is formed at a surface of the magnetic body.

The radiating conductor may include a conductor selected from the group composing of a print of a conductive metal, a metal foil, and a metal wire. Or, the radiating conductor may be formed of sputtering, vapor deposition, or plating of or with a conductive metal, or other thin film process. Or, the radiating conductor may include a conductor pattern on a resin film or thin resin substrate.

In addition, a part of the magnetic body may be replaced by a non-magnetic ceramic.

Besides, the magnetic field applying means may apply a magnetic field to the magnetic body by use of a permanent magnet, or may apply a magnetic field to the magnetic body by use of an electromagnet.

Further, as substitute means for the magnetic body and the magnetic field applying means, a permanent magnet material such as barium ferrite having a remnant magnetization may be used as wavelength-shortening means.

According to an embodiment of the present invention, it is possible to provide an excellent small-sized antenna capable of being incorporated in an apparatus such as a movable body communication apparatus and capable of receiving electromagnetic waves in the UHF television band with comparatively longer wavelengths.

According to another embodiment of the present invention, it is also possible to provide an excellent antenna configured in a small size while being improved in standing wave ratio in the use band by shifting the resonance point frequency into a lower band through a wavelength-shortening effect.

According to another embodiment of the present invention, it is further possible to provide an excellent antenna configured in a small size by utilizing a wavelength-shortening effect obtained from a magnetic body having both a dielectric property and a magnetic property.

Furthermore, according to another embodiment of the present invention, by the wavelength-shortening effect obtained through an arrangement in which a magnetic body carrying a DC magnetic field is put close to the antenna conductor, the resonance point frequency can be shifted to a more lower band, and the standing wave ratio in the use band can be improved, so that a marked reduction in the antenna size can be achieved. The antenna according to an embodiment of the present invention is applicable as a small-sized antenna for reception of the One Seg broadcast (UHF band) among the ground-wave digital broadcasts, for example.

The above and other needs, features, and advantages of the present invention will become apparent from the following description when taken in conjunction with the accompanying drawings which illustrate preferred embodiments of the present invention.

DETAILED DESCRIPTION OF THE PREFERRED EMBODIMENTS

Figure 1:
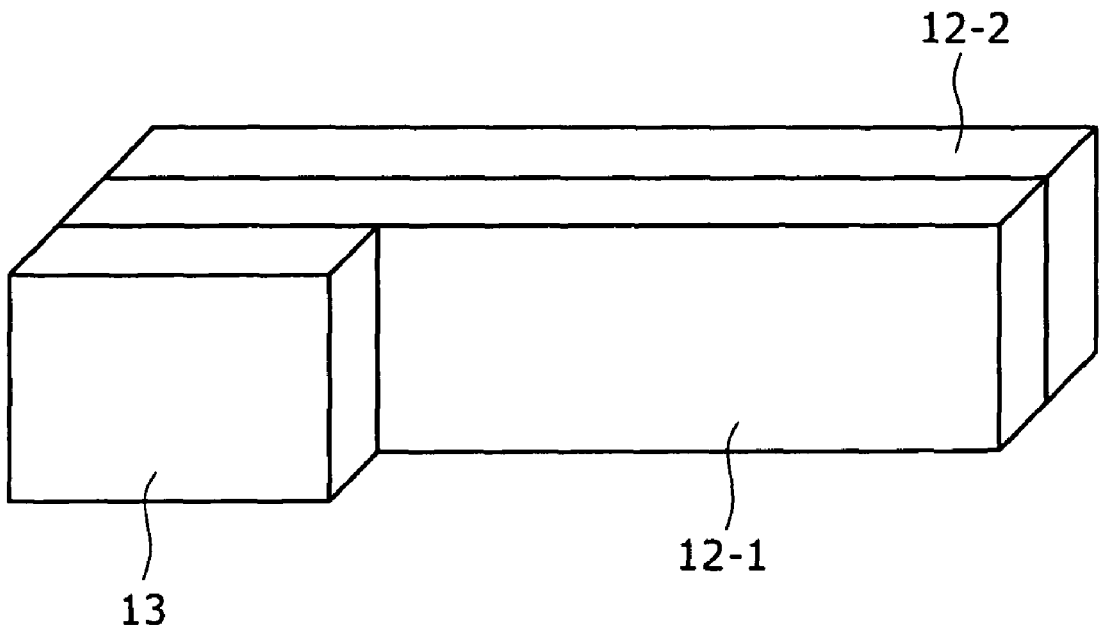
FIG. 1 shows the appearance configuration of a chip antenna according to an embodiment of the present invention.

Now, an embodiment of the present invention will be described below referring to the drawings.

The present invention pertains to a small-sized antenna capable of being incorporated in an apparatus such as a movable body communication apparatus, particularly to an antenna capable of receiving electromagnetic waves in the UHF television band with comparatively long wavelengths.

In general, the element length of an antenna is set to about quarter wavelength relevant to the operating frequency. For a reduction in antenna size, therefore, it may be necessary to shorten the wavelength of the electromagnetic field between the radiating conductor and the ground conductor. There has been known a method in which a material having a wavelength-shortening effect, such as a dielectric and a magnetic body, is disposed in the vicinity of the radiating conductor. Particularly where a magnetic body is used, it may be possible to obtain a wavelength-shortening effect enhanced in an extent corresponding to the product of the relative dielectric constant multiplied by the relative permeability; in this case, however, both a magnetic loss and a dielectric loss will be generated, leading to a lowering in radiation efficiency.

In view of this, according to an embodiment of the present invention, in obtaining the wavelength-shortening effect by use of a magnetic body having both a dielectric property and a magnetic property, a magnetic field is applied to the magnetic body so as to reduce the magnetic loss arising from the magnetic body, whereby a wavelength-shortening effect so high as not to be obtainable with a non-magnetic dielectric can be obtained.

Figure 2:
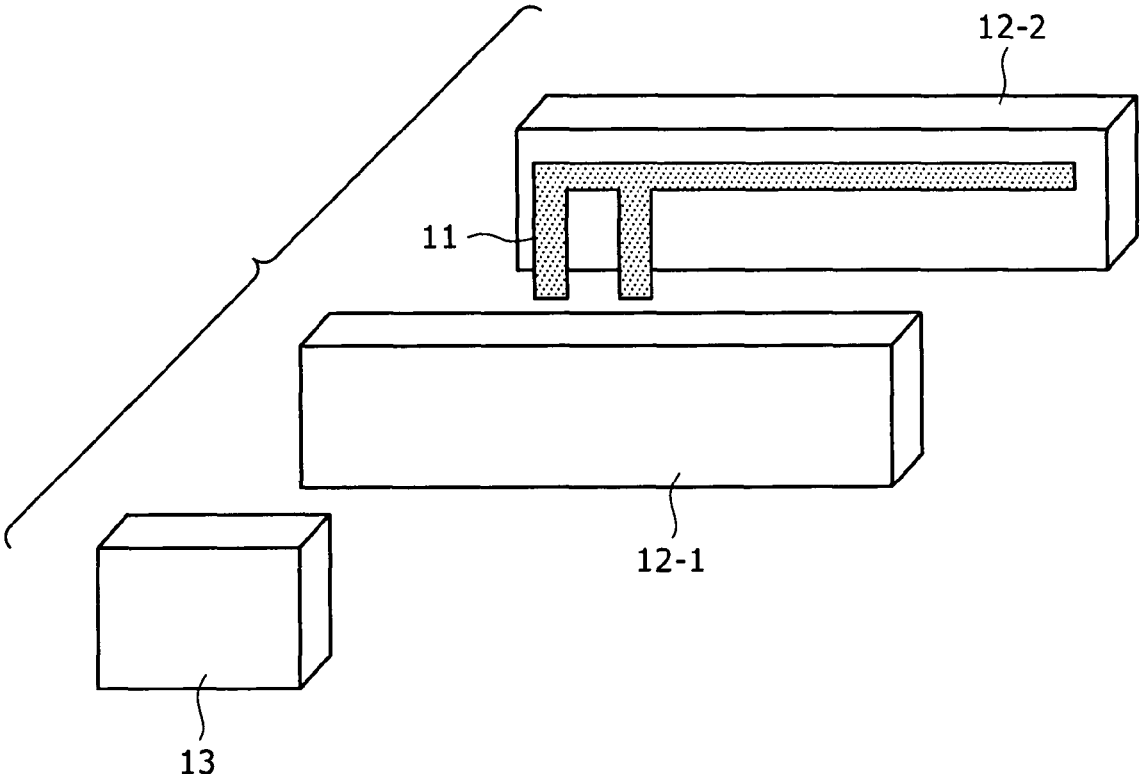
FIG. 2 illustrates the component parts of the chip antenna shown in FIG. 1.
Figure 3:
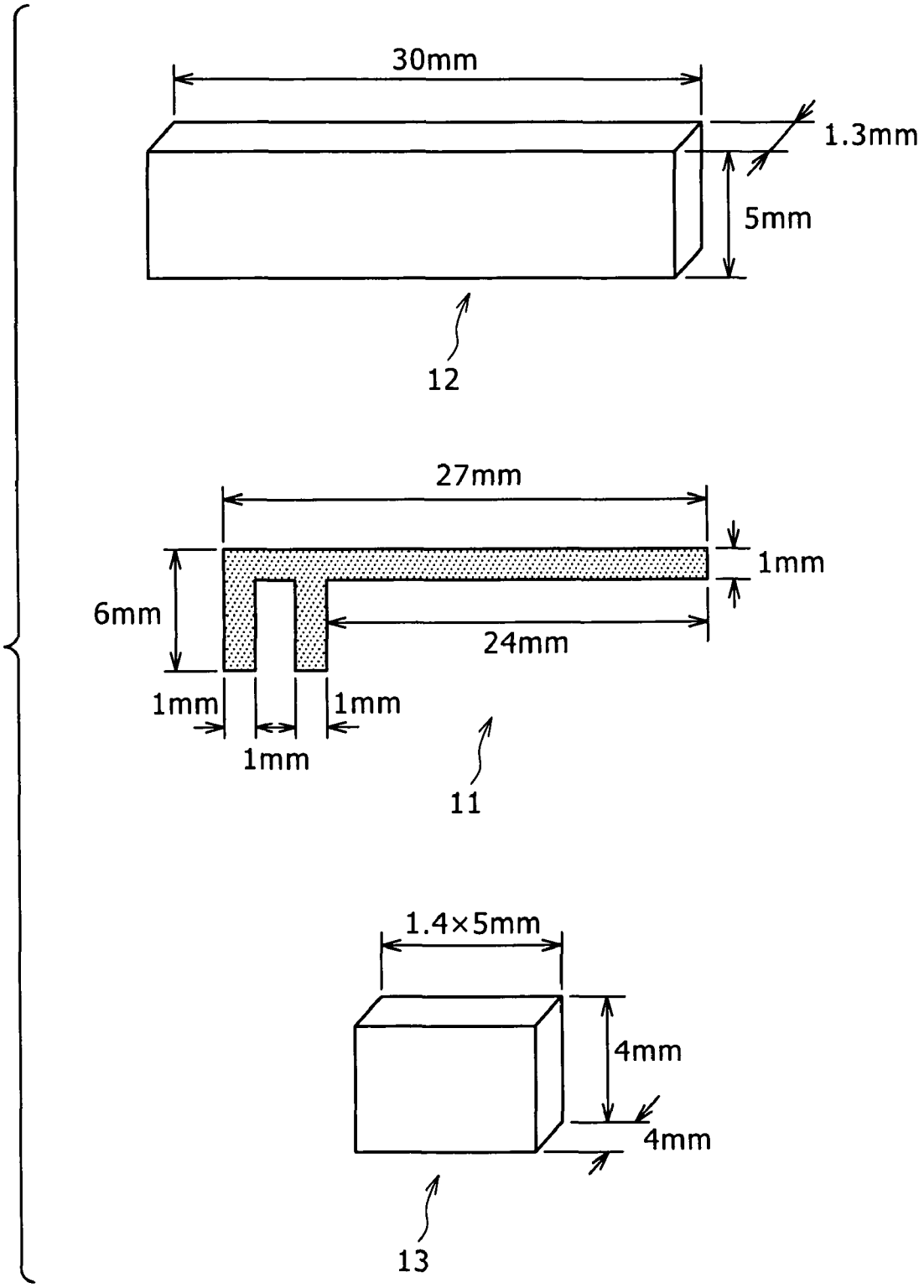
FIG. 3 shows a specific example of the dimensions of the component parts of the chip antenna shown in FIG. 1.

FIG. 1 shows the appearance configuration of a chip antenna according to an embodiment of the present invention; FIG. 2 illustrates the component parts of the chip antenna; and FIG. 3 shows an example of the dimensions of the component parts.

A radiating conductor 11 is configured as a inverse F pattern of a copper foil, and is sandwiched between two sheets of magnetic material blocks 12-1 and 12-2. The projecting end portions of the F shape are exposed from the magnetic material blocks 12-1 and 12-2, and constitute a feeder part for feeding the radiating conductor with electricity.

In the case of a quarter-wavelength grounded antenna, the current distribution is maximized at the feeder end and is zero at the open end. Therefore, in order to effectively utilize the permeability of the magnetic body, it is effective to dispose the magnetic body at a portion where current density is high. In addition, it is effective to apply an external magnetic field, which is applied for reducing the loss due to the magnetic body, to a portion where the current density is high. In view of this, in the present embodiment, a magnetic field applying part 13 is attached to the outside of the magnetic material block 12-1 so that the magnetic field is applied in the vicinity of the feeder part. The magnetic field applying part 13 may be composed of a permanent magnet or an electromagnet.

The magnetic material blocks 12-1 and 12-2 sandwiching the radiating electrode 11 therebetween and the magnetic field applying part 13 are fixed, for example, by winding a polyimide tape (not shown) therearound, but the method of fixation or adhesion is not particularly limited.

Each of the magnetic material blocks 12-1 and 12-2 is, for example, a block member measuring 30 mm in length, 5 mm in width, and 1.5 mm in thickness, produced by grinding a polycryatalline body of a YIG (yttrium iron garnet) based ferrite in which part of iron (Fe) has been replaced by aluminum (Al) and manganese (Mn) and which has a saturation magnetic flux density of 1,750 G.

The radiating electrode 11 is, for example, a pattern obtained by cutting a 35 μm thick copper foil into the inverse F shape as shown in the figure. While the radiating electrode 11 is sandwiched between the same-sized magnetic material blocks 12-1 and 12-2 to form an electrode-incorporating type antenna in the embodiment shown in FIGS. 1 and 2, there may be adopted a type in which a radiating electrode pattern is formed at a surface of the magnetic material block.

In the case of using a permanent magnet as the magnetic field applying part 13, an Nd—Fe—B based chip magnet may be utilized, for example. The angular chip magnet used in FIG. 1 was 4 mm×4 mm×1.4 mm in size, and the magnetization direction was set perpendicular to the plate surface of the chip magnet (namely, the surface of the copper foil pattern of the radiating electrode 11). When the number of sheets of the chip magnets stacked is increased or decreased, the magnetic field strength in the vicinity of the magnetic pole is varied within some range. In this embodiment, the number of sheets of the chip magnets was five, and the magnetic field strength in the vicinity of the magnetic pole in this case is about 5,400 Oe.

Incidentally, the chip antenna is the generic name for rectangular parallelopiped flat antennas, which have the general property of being suited to reductions in size and weight. It is to be noted here, however, the gist of the present invention is not limited to the chip antenna but is naturally applicable to other antennas.

Figure 4:
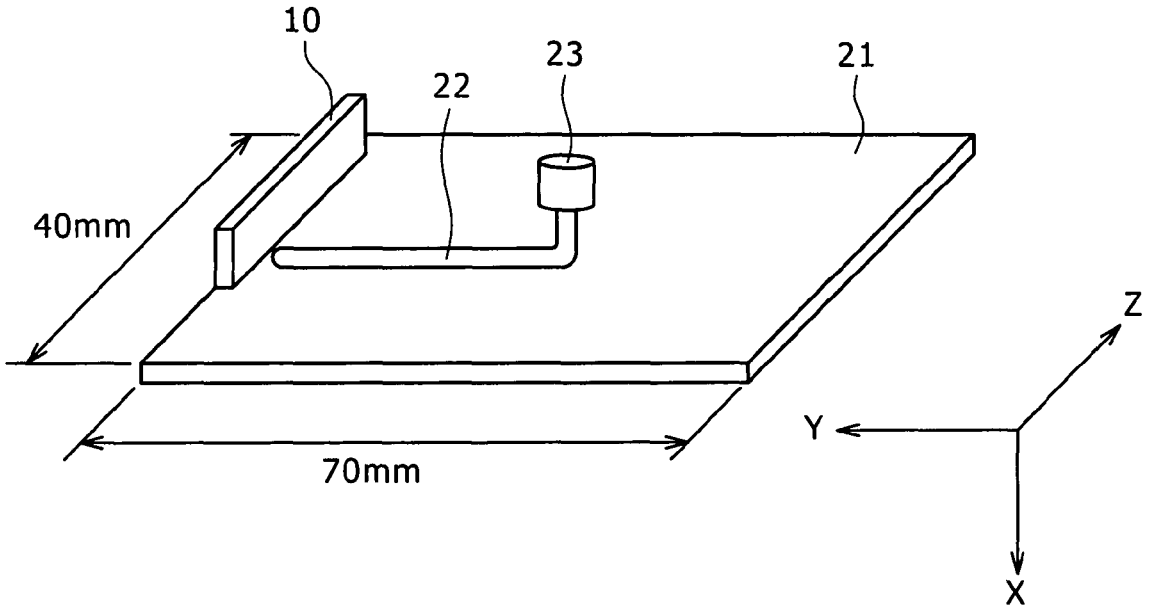
FIG. 4 shows an appearance configuration of an evaluation board used for evaluation of the chip antenna shown in FIG. 1.
Figure 5:
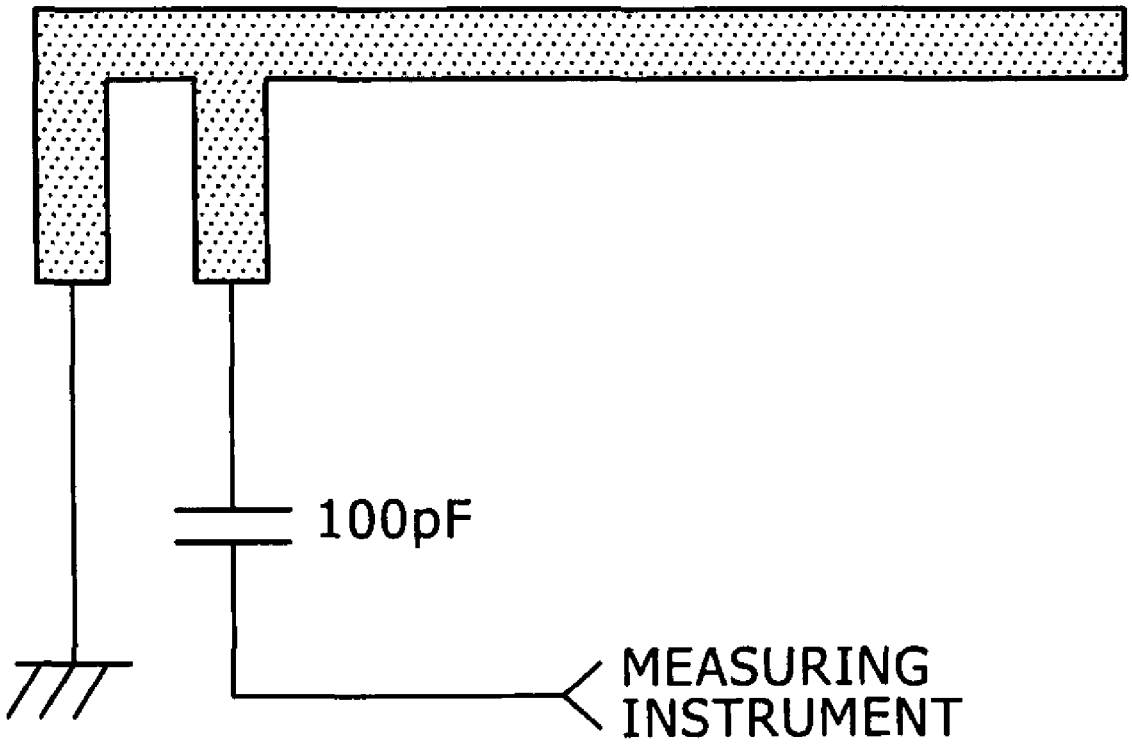
FIG. 5 is a connection diagram for measurement conducted using the evaluation board shown in FIG. 4.

FIG. 4 shows the appearance configuration of an evaluation board used for evaluation of the operating characteristics of the chip antenna shown in FIG. 1; and FIG. 5 is a connection diagram for measurement conducted by use of the evaluation board.

The evaluation board 21 includes a double-sided copper-clad glass-epoxy board of 40 mm×70 mm×1 mm in size, wherein a copper foil tape is adhered to the outer periphery of the board, and conductors on the face side and the back side of the double-sided copper-clad board 21 are connected by soldering. The copper-clad board 21 functions as a ground when the chip antenna 10 is mounted thereon as shown in FIG. 4.

As shown in FIG. 1, the radiating conductor of the chip antenna 10 is composed of the inverse F copper foil pattern. As shown in FIG. 5, one of the two projecting ends of the F shape is connected to the ground, and the other is made to function as the feeder end through a 100 pF chip capacitor. In addition, the central conductor of a cemi-rigid coaxial cable with a characteristic impedance of 50Ω is connected to the feeder end, whereas an SMA connector 23 is attached to the other end of the coaxial cable 22 for the purpose of connection to a measuring instrument (not shown). (The SMA (SubMiniature Type A) connector is the connector most commonly used for microwave band applications, it has an inside diameter of 1.27 mm and an outside diameter of 4.2 mm, and Teflon (trade name) (relative dielectric constant: about 2.0) is used as an insulator supporting the inner conductor.)

With the evaluation board 21 connected to a network analyzer (not shown), S11 of the S parameters can be measured. The S (Scattering) parameters are parameters representing a black box having two ports (inlet and outlet), into and out of which a wave of AC signal is assumed to go, according to the manners of reflection and transmission of the wave, and the S parameters are defined by the following equation (7), where a1 and a2 are input voltages, and b1 and b2 are reflected voltages.

$$\begin{pmatrix} b_1 \\ b_2 \end{pmatrix} = \begin{pmatrix} S_{11} & S_{12} \\ S_{21} & S_{22} \end{pmatrix} \begin{pmatrix} a_1 \\ a_2 \end{pmatrix} \tag{7}$$

Of the S parameters in the above equation (7), S11 represents a reflection coefficient, and S21 represents a coupling coefficient. A lower value of the reflection coefficient S11 indicates an antenna with better matching. On the other hand, S21 corresponds to the coupling characteristic of the antenna, i.e., the amplitude characteristic (attenuation factor) of the signal transmitted from a transmitter to a receiver; when this characteristic is high and flat in the desired frequency band, the influence of multi-pass is little, which is favorable. Here, voltage standing wave ratio (VSWR) is further determined from S11. The VSWR is the maximum-to-minimum ratio of the voltage in a transmission line; VSWR=1 when the reflection coefficient is zero, and VSWR becomes higher as the reflection coefficient approaches one.

Figure 6:
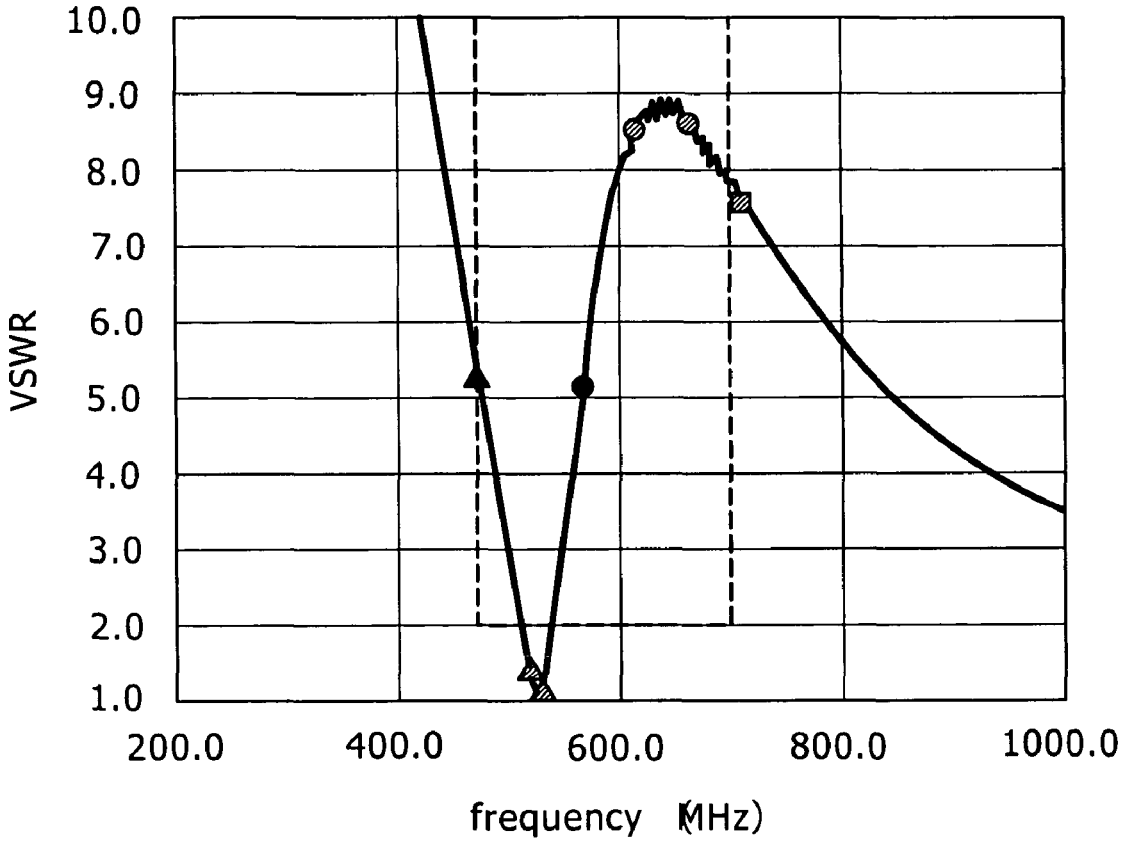
FIG. 6 is a diagram showing the VSWR measured over the range of from 200 MHz to 1 GHz for the chip antenna shown in FIG. 1.

FIG. 6 shows the VSWR measured over the range of from 200 MHz to 1 GHz for the chip antenna shown in FIG. 1. As is seen from the figure, the VSWR shows a resonance characteristic with a local minimum in the vicinity of 526 MHz. In addition, the width of the frequency band where VSWR≦3 is 53 MHz, centered at 526 MHz. When the radiating electrode of the antenna is assumed to be isolated in air ($\epsilon_r$=1, $\mu_r$=1), the quarter wavelength relevant to the resonance frequency of 526 MHz is 143 mm. Taking into consideration the fact that the element length of the radiating conductor in this embodiment is 27 mm and this length is the quarter wavelength relevant to the resonance frequency, the arrangement of the ferrites in close contact with both sides of the radiating conductor has shortened the effective antenna element length to about ⅕ times the original value. Besides, it is obvious that the antenna can be reduced in size if a ferrite having both a dielectric property and a magnetic property is used as a wavelength-shortening medium and a magnetostatic field is applied externally.

Figure 7:
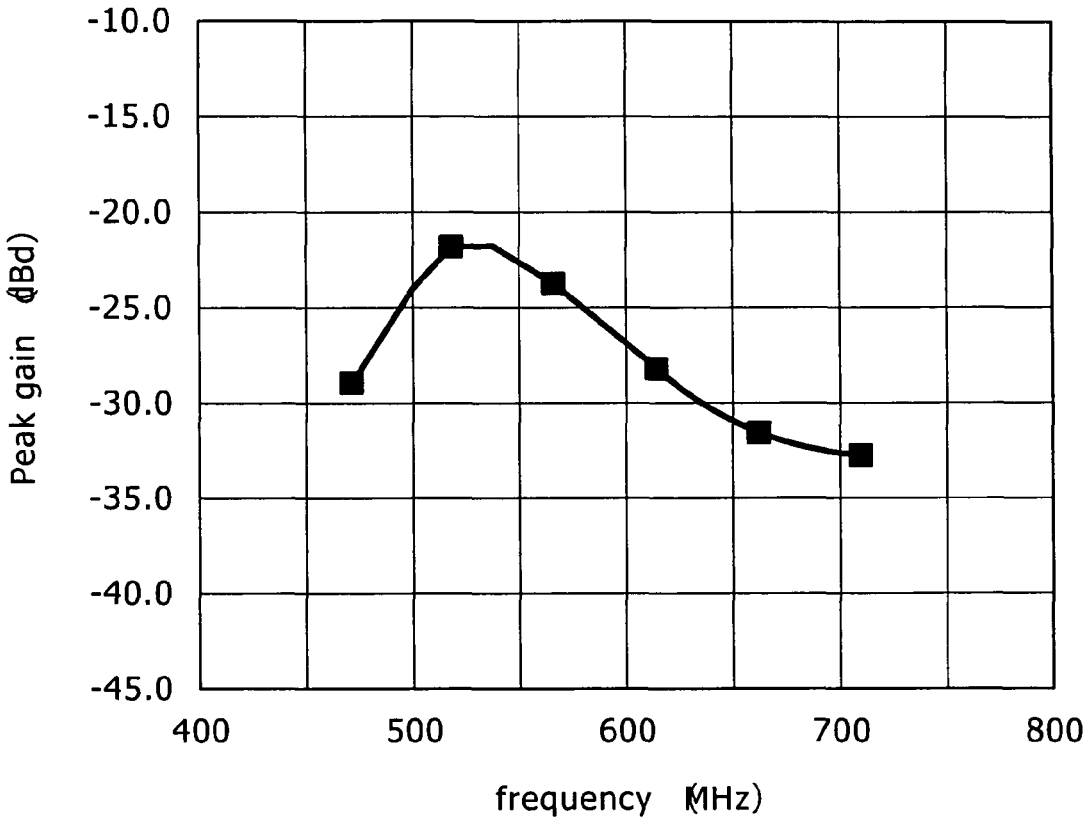
FIG. 7 is a diagram showing the measurement results of reception sensitivity of the chip antenna shown in FIG. 1.

In addition, the reception sensitivity of the chip antenna can be measured by a method in which the evaluation board 21 fitted with the chip antenna is connected to a spectrum analyzer and is irradiated with electromagnetic waves from a signal source connected with a logarithmic period antenna. This measurement is conducted in a radio wave dark room by a method in which the evaluation board located at position spaced by 3 m from the transmission antenna is rotated about each of the X, Y and Z axes shown in FIG. 4 and the variations in the reception sensitivity during the rotation are measured. FIG. 7 shows the frequency variation of the peak gain measured over the range of 471 to 711 MHz, as an example of the measurement results of the reception sensitivity. In the example shown in the figure, the maximum gain was −22 dBd at 520 MHz.

It is seen from the measurement results shown in FIGS. 6 and 7 that the antenna can be reduced in size if a ferrite having both a dielectric property and a magnetic property is used as the wavelength-shortening medium and a magnetostatic field is externally applied thereto. The present inventors understand this as a synergistic effect of a high wavelength-shortening effect obtained based on the dielectric property and the magnetic property possessed by the ferrite and the reduction in the magnetic loss due to the ferrite by the application of a DC magnetic field.

For confirmation of the above understanding, a similar measurement was conducted by removing the permanent magnet 13 from the chip antenna 10 shown in FIG. 1 and without applying any DC magnetic field to the ferrite.

Figure 8:
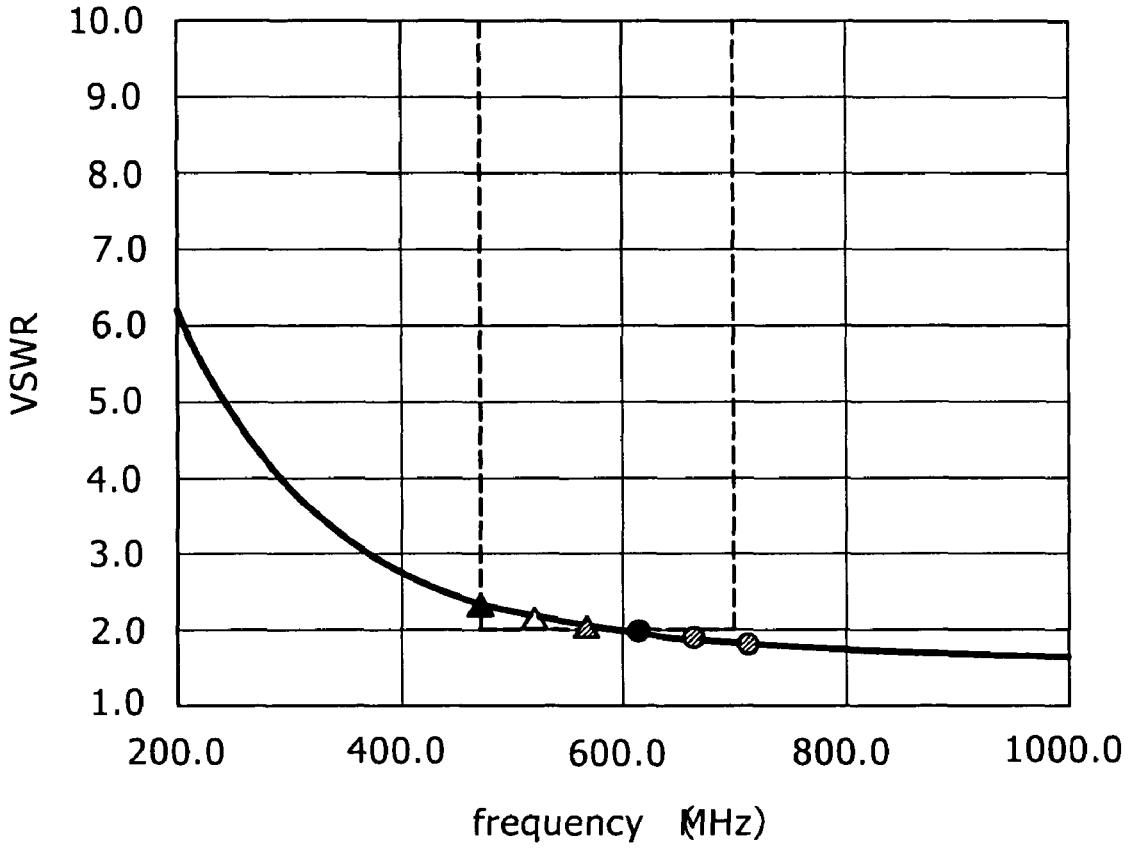
FIG. 8 is a diagram showing the VSWR measured over the range of from 200 MHz to 1 GHz for the chip antenna from which the permanent magnet 13 had been removed.

FIG. 8 shows the VSWR measure over the range of from 200 MHz to 1 GHz for the chip antenna 10 from which the permanent magnet 13 had been removed. As is clear from comparison of FIG. 8 with FIG. 6, the VSWR in FIG. 8 tends to be monotonously reduced with an increase in frequency, but no distinct resonance point is recognized therein.

Figure 9:
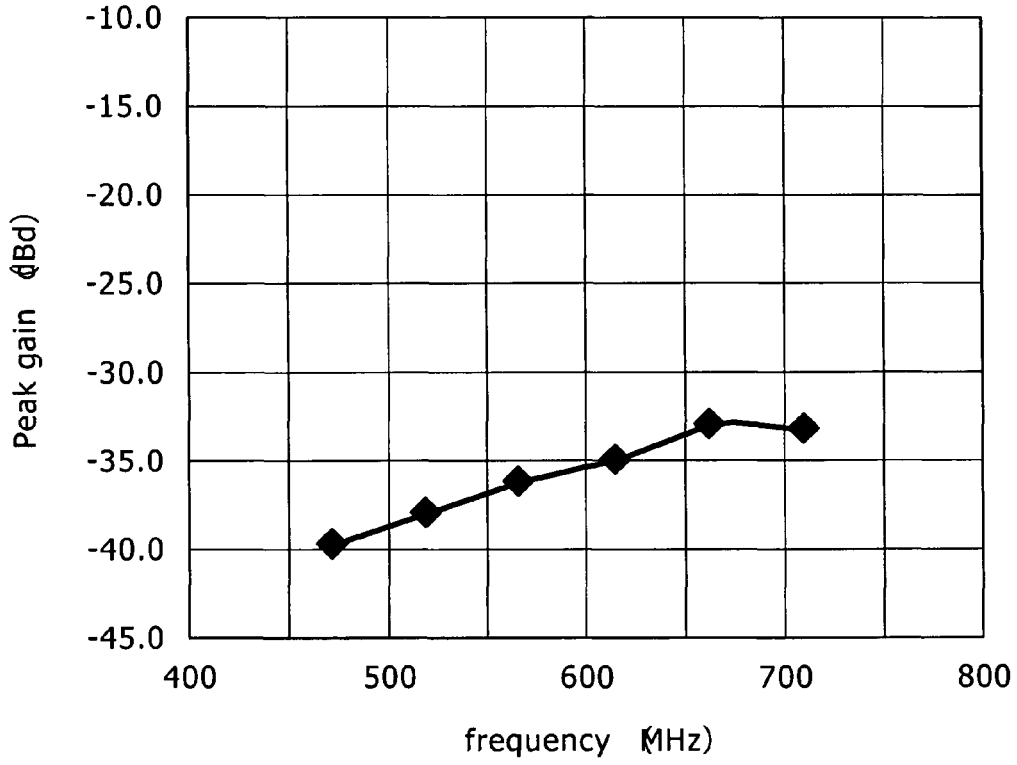
FIG. 9 is a diagram showing the measurement results of reception sensitivity of the chip antenna from which the permanent magnet 13 had been removed.

In addition, FIG. 9 shows the measurement results of the reception sensitivity of the chip antenna from which the permanent magnet 13 had been removed. As is seen from comparison of FIG. 9 with FIG. 7, in the case where no magnetic field is applied to the antenna, not only the VSWR is not lowered but also the gain is extremely low, so that the chip antenna does not function at all as an antenna.

As is understood from the measurement results shown in FIGS. 8 and 9, in the case of a chip antenna configured by use of a magnetic body, the chip antenna would almost not operate as an antenna if the external magnetic field is eliminated. In order to elucidate the reason for this, the permeability of the ferrite material to be used as the magnetic material blocks 12 in the chip antenna shown in FIG. 1 was measured.

In measuring the permeability, first, a ring-shaped specimen of 7 mm in outside diameter, 3 mm in inside diameter and 0.8 mm in thickness is cut out from a magnetic material board by use of an ultrasonic machine. Then, a double silk-covered wire with a diameter of 0.3 ψ is wound five times around the ring-shaped specimen. Here, let the inductance of the double silk-covered wire be L, and let the loss due to the double silk-covered wire, if any, be represented as resistance R, then the series impedance Z of L and R is represented by the following equation (8).

$$Z=j\omega L+R \tag{8}$$

When the impedance Z is expressed as jωμL' and the real part and the imaginary part of the relative permeability μ are expressed respectively as μ' and μ" so as to obtain a complex form, the above equation (8) is deformed into the following equation (9).

$$Z=j\omega(\mu'-j\mu'')L'=j\omega\mu'L'+\omega\mu''L' \tag{9}$$

Thus, since L=μ'L' and R=ωμ"L', it is possible, by measuring the impedance by an impedance analyzer, to obtain the real part μ' of the relative permeability from the inductance L of the impedance obtained, and to obtain the imaginary part μ" of the relative permeability from the resistance R (refer to, for example, Keizo Ota, Fundamentals of Magnetic Engineering II, pp. 304 to 307, Kyoritsu Zensho 201, Kyoritsu Shuppan in 2004). Further, from these values, the loss factor tan δ due to magnetism can be calculated.

Figure 10:
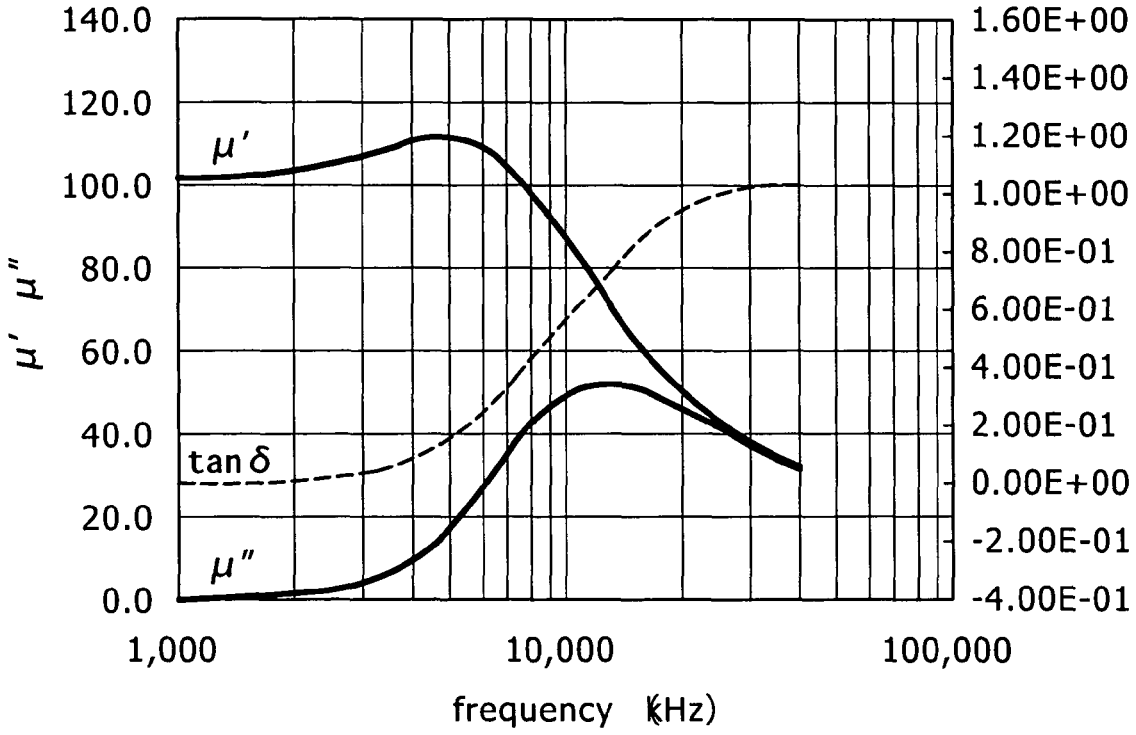
FIG. 10 is a diagram showing the variation in permeability of a ring-shaped magnetic body measured over the range of from 1 to 40 MHz, with no magnetic field applied.

FIG. 10 shows the variation in permeability of the above-mentioned ring-shaped magnetic body measured over the range of from 1 to 40 MHz, with no magnetic field applied. As is clear from the figure, where no magnetic field is externally applied, the real part μ' of the relative permeability shows a high value of around 100 in a low frequency region of about 1 MHz, but the real part μ' decreases rapidly whereas the imaginary part μ" increases rapidly with an increase in frequency. As a result, in a frequency region of not less than 10 MHz, the loss factor tan δ is roughly 1, indicating the generation of a large loss.

Figure 11:
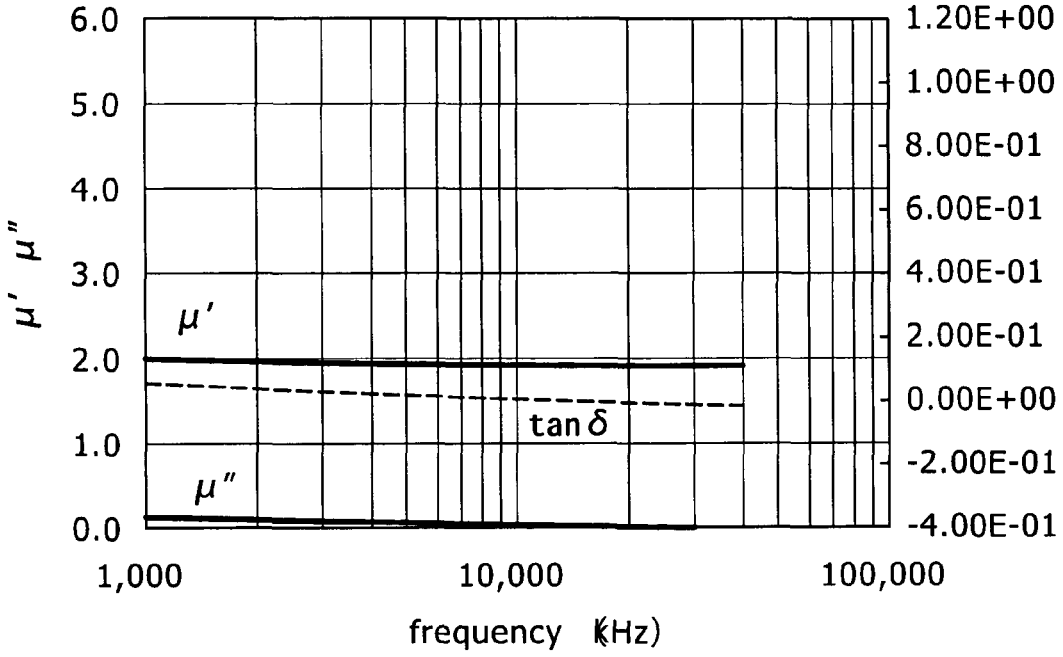
FIG. 11 is a diagram showing the variation in permeability of the ring-shaped magnetic body measured over the range of from 1 to 40 MHz, with a DC magnetic field applied.

Besides, FIG. 11 shows the variation in permeability of the ring-shaped magnetic body measured over the range of from 1 to 40 MHz, with a DC magnetic field applied. It is to be noted here that a permanent magnet was used for applying the DC magnetic field, the direction of the magnetic field applied was set orthogonal to the magnetic path direction (the ring circumference direction) at the time of measuring the permeability, and a magnetic field of about 5,000 Oe was applied to the vicinity of the surface of the ring-shaped specimen. Though the value of μ' is lower than that in the case of no magnetic field, the value is almost independent of frequency over the range of 1 to 40 MHz; thus, a substantially flat frequency characteristic is shown over the range. A further characteristic feature lies in that the value of the imaginary part μ" of the permeability is extremely low over a wide frequency range, with the result that the loss factor tan δ shows a value of substantially zero over the range of 1 to 40 MHz.

Summing up the measurement results shown above, it can be said that where no external magnetic field is applied to the antenna, a large magnetic loss is generated in the region of no more than several tens of megahertz, thereby heavily spoiling the antenna characteristics, but that where a magnetic field is applied, the loss is markedly reduced and the antenna characteristics in a high frequency region can be maintained thereby.

Now, the influence of the magnetic flux density possessed by a magnetic body on the wavelength-shortening effect will be discussed below. The magnetic material blocks 12 sandwiching the radiating conductor 11 therebetween in the chip antenna shown in FIG. 1 were replaced by blocks measuring 30 mm in length, 5 mm in width and 1.5 mm in thickness obtained by grinding an Mn- and Al-added YIG based ferrite polycrystalline body having a saturation magnetic flux density of 400 G. Then, similarly to the above, a permanent magnet was provided so as to apply a magnetic field to the radiating element of the chip antenna, in the vicinity of the feeder part. It is to be noted here that a gap is provided between the ferrite block and the permanent magnet so that the magnetic field applied to the ferrite was regulated to about 1,000 Oe.

Figure 12:
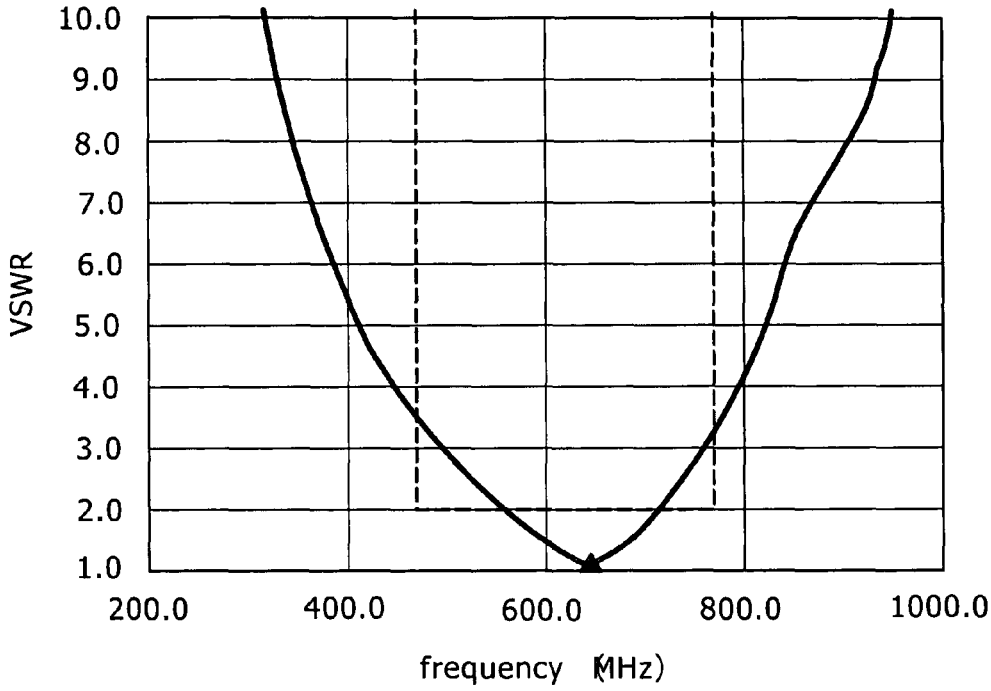
FIG. 12 is a diagram showing the VSWR measured over the range of from 200 MHz to 1 GHz for a chip antenna in which an original magnetic body had been replaced by a magnetic body having a lower saturation magnetic flux density.

In this case also, as shown in FIG. 4, the chip antenna was attached to a double-sided copper-clad glass-epoxy board measuring 40 mm×70 mm×1 mm to form an evaluation board 21, the evaluation board 21 was connected to a network analyzer (not shown), and S11 was measured, to thereby obtain the VSWR. FIG. 12 shows the measurement results of VSWR. As shown in the figure, the VSWR had a local minimum value in the vicinity of 645 MHz, and the local minimum value was substantially one. Besides, the value of VSWR showed 3.5 in the range of 470 to 770 MHz, which is the UHF TV broadcast frequency band.

Figure 13:
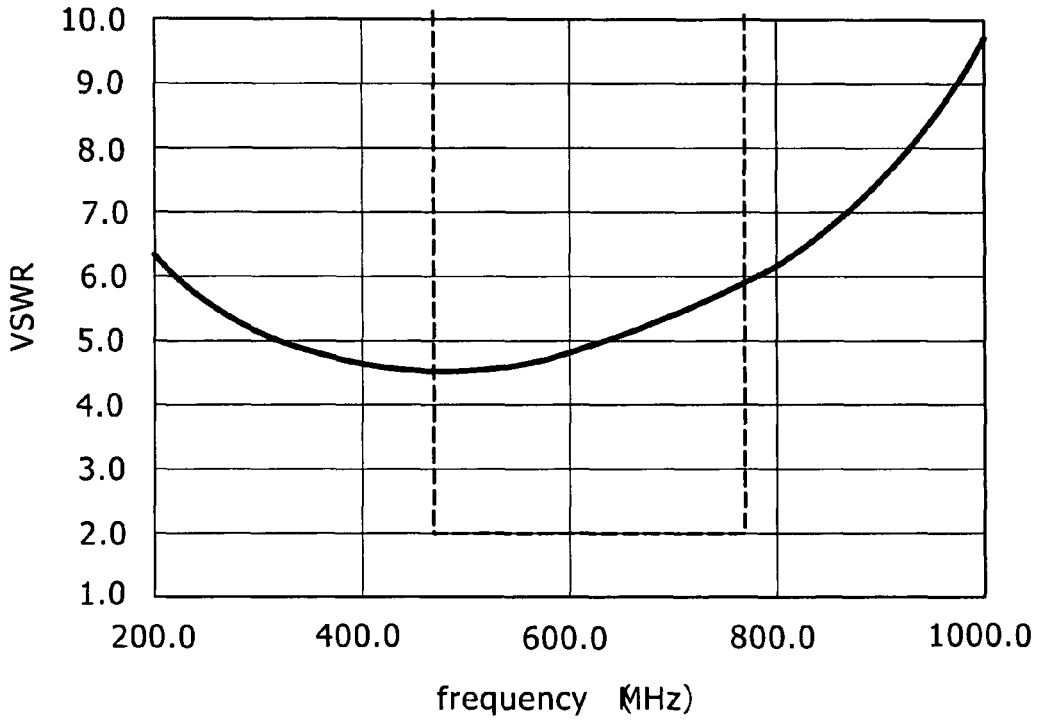
FIG. 13 is a diagram showing the VSWR measured over the range of from 200 MHz to 1 GHz for a chip antenna from which the permanent magnet had been removed.

In addition, FIG. 13 shows the results of obtaining VSWR from the measurement results of S11 in the case where the permanent magnet had been removed from the chip antenna configured by use of the Mn- and Al-added YIG based ferrite polycrystalline body having a saturation magnetic flux density of 400 G, for confirming the effect of application of a DC magnetic field. A comparison of FIG. 13 with FIG. 12 shows that the peak indicating the resonance which had appeared on the frequency characteristic of VSWR when the DC magnetic field had been applied became indistinct in this case, and, further, the value of VSWR did not decrease to or below four.

Besides, a ring-shaped specimen of 7 mm in outside diameter, 3 mm in inside diameter and 0.8 mm in thickness was cut out from a magnetic material block composed of an Mn- and Al-added YIG based ferrite polycrystalline material having a saturation magnetic flux density of 400 G, then a double silk-covered wire with a diameter of 0.3 ψ was wound five times around the ring-shaped specimen, and measurement of permeability was conducted.

Figure 14:
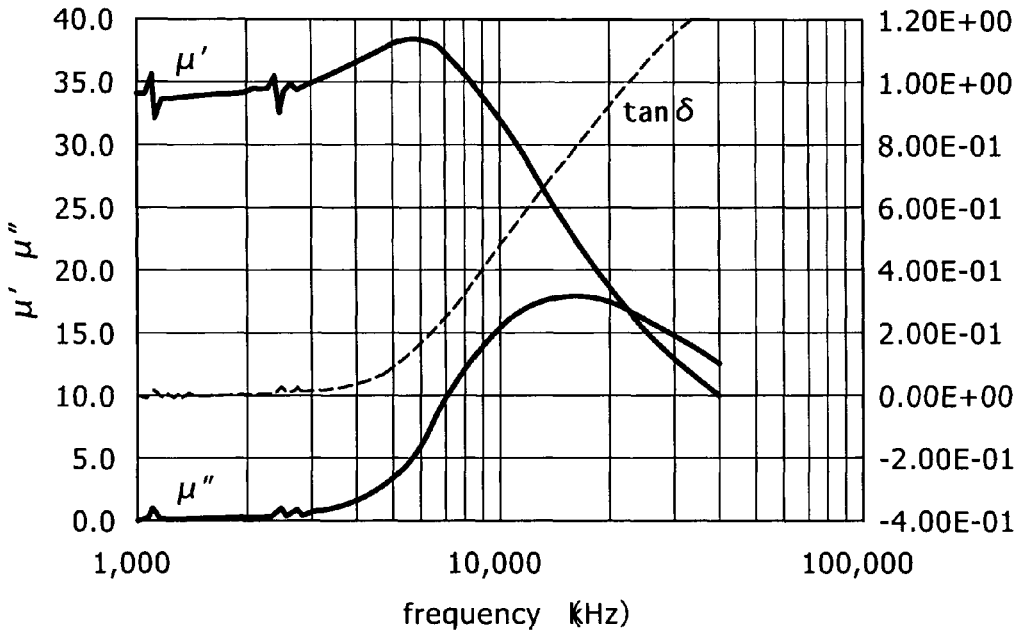
FIG. 14 is a diagram showing the variation in permeability of a ring-shaped magnetic body over the range of from 1 to 40 MHz, with no magnetic field applied.
Figure 15:
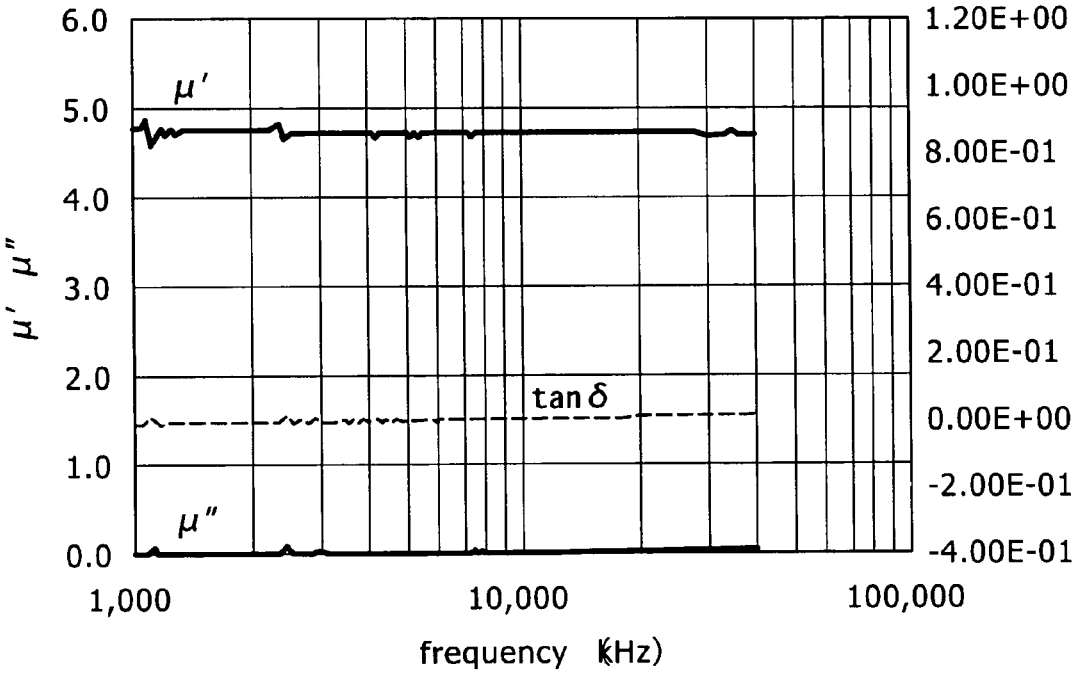
FIG. 15 is a diagram showing the variation in permeability of the ring-shaped magnetic body over the range of from 1 to 40 MHz, with a magnetic field applied.

FIGS. 14 and 15 show the measurement results of permeability in the case of no magnetic field applied to the ring-shaped specimen and in the case of a magnetic field applied to the specimen, respectively. In the latter case, the direction of the magnetic field applied was set orthogonal to the magnetic path direction (the ring circumference direction) at the time of measuring the permeability, and a magnetic field of about 5,000 Oe was applied to the vicinity of the ring specimen surface. Like in the case shown in FIGS. 10 and 11, in the case of no magnetic field applied, the magnetic loss rapidly increased starting from a comparatively low frequency region of several tens of megahertz. On the contrary, where a DC magnetic field was applied in the direction orthogonal to the permeability measuring direction, the magnetic loss was reduced markedly, as seen from the figure.

Now, the wavelength-shortening effect due to the permeability in the chip antenna configured by use of a magnetic body having both a dielectric property and a magnetic property will be discussed. Here, for confirmation of the effect of the magnetic body, a chip antenna the same as that shown in FIG. 1 except for use of a dielectric in place of the magnetic substance was produced, and the wavelength-shortening effect of the chip antenna was examined. In this case, an alumina-based ceramic having a relative dielectric constant of 20 was used as the dielectric.

Figure 16:
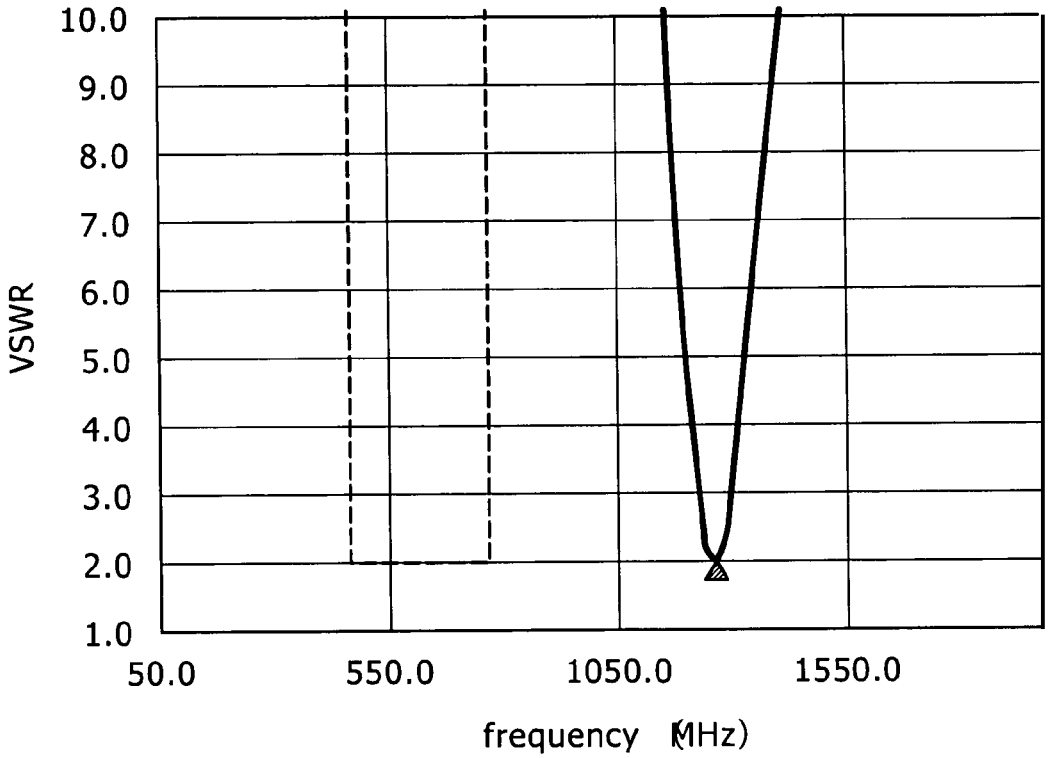
FIG. 16 is a diagram showing the measurement results of VSWR for a chip antenna configured by using a dielectric in place of a magnetic body.

In this case also, as shown in FIG. 4, the chip antenna was mounted on a double-sided copper-clad glass-epoxy board measuring 40 mm×70 mm×1 mm to produce an evaluation board 21, the evaluation board 21 was connected to a network analyzer (not shown), and S11 was measured, to obtain VSWR. FIG. 16 shows the measurement results of VSWR. As seen from the figure, where the non-magnetic dielectric was used in place of the magnetic material, only the resonance point appeared in a high frequency region in the vicinity of 1.33 GHz, and there was not found such a lowering of VSWR in the vicinity of 500 to 600 MHz as those shown in FIGS. 6 and 12.

Figure 17:
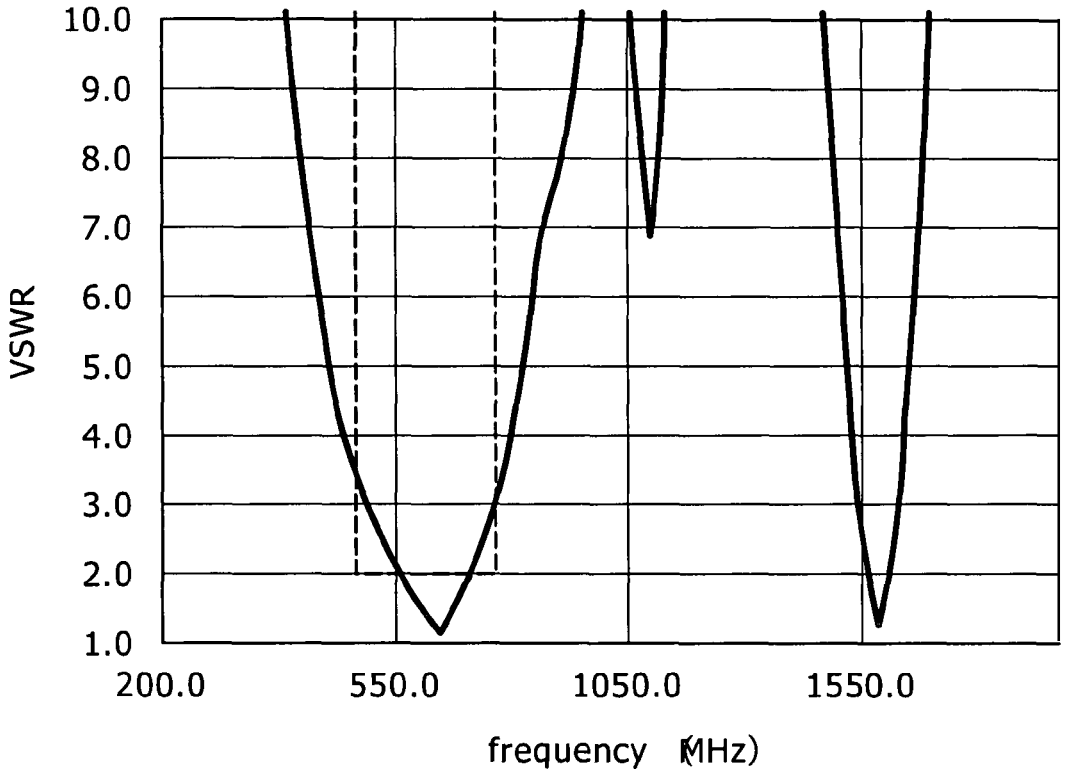
FIG. 17 is a diagram showing the measurement results of VSWR in a wider frequency range for a chip antenna configured by use of a magnetic body having a saturation magnetic flux density of 400 G.

The VSWR in the range of from 200 MHz to 1 GHz for the chip antenna configured by use of a magnetic material having a comparatively low saturation magnetic flux density of 400 G is the same as above-described referring to FIG. 12. Here, as a reference, the VSWR was measured over a wider frequency range, and the results are shown in FIG. 17. It was confirmed that in addition to a local minimum of VSWR present in the vicinity of 500 to 600 MHz, there appeared a peak also in the vicinity of 1.55 GHz. Incidentally, in the case of a chip antenna configured by use of a dielectric having a relative dielectric constant of 20, a resonance point appeared at 1.33 GHz.

Besides, taking into account the fact that the relative dielectric constant of the ferrite material used here is about 14 in the GHz band, the peak of VSWR appearing in the GHz region is considered to be due to the dielectric constant which was remaining though the permeability was approaching one. In other words, when a magnetic material having both a dielectric property and a magnetic property is used as a wavelength-shortening material, such a high wavelength-shortening effect as not to be obtainable with a non-magnetic dielectric can be obtained.

In the present specification, the wavelength-shortening effect of a magnetic material was verified, taking as an example a quarter-wavelength grounded antenna which is considered to be fundamental as an antenna element. As a result, it has been certified that an antenna which would need a length of about 12 cm if air is deemed as a dielectric can be shortened to a tiny length of about 3 cm. In addition, it has also been certified that, even when compared to an antenna configured by use of an ordinary dielectric ceramic conventionally known, the antenna element length can further be shortened to about ½ times the original length.

While the present invention has been detailed herein referring to the specific embodiments thereof, it is obvious that modifications or substitutions can be applied to the embodiments by those skilled in the art within the scope of the gist of the invention.

For example, where an antenna according to an embodiment of the present invention is applied, for example, to a portable TV receiver, the antenna can be used in place of a long rod antenna in the past and can be incorporated in the apparatus, whereby portability of the apparatus can be enhanced remarkably. Besides, the incorporation of the antenna into an apparatus promises secondary effects such as enhancement of the degree of freedom in designing the appearance of the apparatus and elimination of the need for concern about antenna breakage or the like.

In addition, while the quarter-wavelength grounded antenna has been taken as an example and the effects thereof have been described herein, it is obvious that the wavelength-shortening effect is not limited to the grounded antenna taken as an example herein.

While the copper foil has been used as the radiating conductor in the embodiments described herein, it is natural that the same or equivalent effect can be obtained also where a radiating electrode pattern is formed by use of a conductive coating material or the like. Furthermore, the same or equivalent effect can be obtained also where a radiating electrode pattern is painted on a flexible wiring board or a glass-epoxy or other wiring board.

Besides, while the permanent magnet has been used as a section applying an external magnetic field in the embodiments described herein, application of a DC magnetic field by use of an electromagnet external to the antenna is utterly equivalent to this configuration. Further, where the magnetic field applying section is composed of a permanent magnet material having a remnant magnetization such as barium ferrite, the section externally applying a magnetic field can be omitted.

In the antenna according to an embodiment of the present invention, the wavelength-shortening section realizing a reduction in size includes the magnetic body showing a dielectric property for producing the wavelength-shortening effect when disposed close to the radiating conductor, and the magnetic field applying section lowering the magnetic loss due to the magnetic body. However, a permanent magnet material capable of being spontaneously magnetized may also be applied as the wavelength-shortening sections.

In brief, the present invention has been disclosed herein in the form of exemplification, and the descriptions herein are not to be construed as limitative. The gist of the present invention is to be judged by taking the claims into account.

What is claimed is:

1. An antenna for receiving electromagnetic waves in a desired frequency band, comprising:

a radiating conductor and a ground conductor which resonate at a resonance point frequency;

a feeder part configured to feed said radiating conductor with a signal;

wavelength-shortening means in which a magnetic body having both a dielectric property and a magnetic property is secured directly to said radiating conductor and which shifts said resonance point frequency lower by a wavelength-shortening effect obtained based on said dielectric property and said magnetic property; and magnetic field applying means configured to apply a magnetic field to said magnetic body so as to reduce a magnetic loss due to said magnetic body, and wherein the wavelength-shortening means is comprised of first and second bodies of magnetic material having both a dielectric property and a magnetic property which are located at opposite sides of the radiating conductor which is a planar structure such that they entirely cover opposite side surfaces of the radiating conductor and further wherein the magnetic field applying means is a permanent magnet structure that is secured to one of the first and second bodies of magnetic material exclusively in a region of the feeder part.

2. The antenna as set forth in claim 1, wherein said wavelength-shortening means has said magnetic body disposed at a portion, where current density is high, of said radiating conductor.

3. The antenna as set forth in claim 1, wherein said magnetic field applying means applies an external magnetic field to said magnetic body, at a portion, where current density is high, of said radiating conductor.

4. The antenna as set forth in claim 1, wherein said radiating conductor is formed in the inside of said magnetic body.

5. The antenna as set forth in claim 1, wherein said radiating body is comprised of a conductor selected from the group composed of a print of a conductive metal, a metal foil, and a metal wire.

6. The antenna as set forth in claim 1, wherein said radiating conductor is formed by use of sputtering, vapor deposition or plating of or with a conductive metal, or other thin film process.

7. The antenna as set forth in claim 1, wherein said radiating conductor is comprised of a conductor pattern on a resin film or a thin resin substrate.

8. The antenna as set forth in claim 1, wherein the magnetic field applying means is arranged such that the magnetic field is applied in the vicinity of a feeder part.

9. An antenna for receiving electromagnetic waves in a desired frequency band, comprising:

a radiating conductor and a ground conductor which resonate at a resonance point frequency;

a feeder part configured to feed said radiating conductor with a signal; and wavelength-shortening means in which a magnetic body having both a dielectric property and a magnetic property is secured directly to said radiating conductor and which shifts said resonance point frequency lower than by a wavelength-shortening effect obtained based on said dielectric property and said magnetic property, wherein the wavelength-shortening means is comprised of first and second bodies of magnetic material having both a dielectric property and a magnetic property which are located at opposite sides of the radiating conductor which is a planar structure such that they entirely cover opposite side surfaces of the radiating conductor and further comprising a magnetic field applying means that is a permanent magnet structure secured to one of the first and second bodies of magnetic material exclusively in a region of the feeder part.

10. The antenna as set forth in claim 9, wherein said permanent magnet is comprised of barium ferrite having a remnant magnetization.

11. The antenna as set forth in claim 9, wherein a magnetic field applying means is arranged such that the magnetic field is applied in the vicinity of the feeder part.

* * * * *